United States Patent [19]

Palm

[11] Patent Number: 4,981,196

[45] Date of Patent: Jan. 1, 1991

[54] CABLE PROTECTOR

[76] Inventor: Richard Palm, 44 Gramercy Park No. 8B, New York, N.Y. 10010

[21] Appl. No.: 518,663

[22] Filed: May 3, 1990

[51] Int. Cl.[5] ..... E04G 3/10

[52] U.S. Cl. ..... 182/112; 182/191; 182/142

[58] Field of Search ..... 182/112, 142, 143, 144, 182/100, 190, 191

[56] References Cited

U.S. PATENT DOCUMENTS

| | | | |
|---|---|---|---|
| 442,961 | 12/1890 | Dixon | 182/100 |
| 538,398 | 4/1895 | Wilber | 182/142 |
| 3,204,726 | 9/1965 | Kerman | 182/142 |
| 4,056,166 | 11/1977 | Rabelos | 182/5 |
| 4,181,194 | 1/1980 | Bassett | 182/142 |

*Primary Examiner*—Reinaldo P. Machado
*Attorney, Agent, or Firm*—Darby & Darby

[57] ABSTRACT

A protective device is disclosed for use with a scaffolding platform of the type which is suspended from an upright structure by means of and movable along at least one cable. The protective device protects an exposed zone of the cable adjacent to the platform against damage. The device comprises a weighted sleeve and means for selectively opening and re-closing the weighted sleeve so that it may be placed around the cable at the exposed zone and thereby protect the same. The weighted sleeve follows said platform under the influence of gravity as the platform is moved along the cable.

11 Claims, 2 Drawing Sheets

CABLE PROTECTOR

FIELD OF THE INVENTION

The present invention relates generally to protective shielding, and more particularly, to devices for protecting structural supporting cable (and rope) from damage.

BACKGROUND OF THE INVENTION

To clean, repair or otherwise maintain the exterior of a building (or other structure), one of two methods is commonly employed. If the building is low, a standard ground-supported scaffolding may be constructed along its face. After the tedious and time-consuming task of constructing the scaffolding is complete, work on the exterior of the building may begin. Once the work is complete, the entire scaffolding must be dissembled. The other method involves the use of a suspension-type scaffolding and is easier and quicker. This type of scaffolding includes a work platform that is typically hung from two cables suspended from a pair of support booms that are mounted on the roof of the building. (The term "cable" as used hereinafter, is intended to include any supporting cord, cable, rope or chain).

Each type of scaffolding has its advantages and drawbacks. The particular type used in any situation is usually determined by the type and shape of the structure, and more importantly, by the amount ant type of work intended to be performed. For example, static scaffolding is typically used for heavy facade replacement or repair to the building's exterior, whereas the less expensive (and more mobile) suspension type scaffolding is more commonly used for simple routine building maintenance such as window cleaning. However, in many instances, usually in urban areas, the static scaffolding is either prohibitively costly or impractical, owing to time constraints, the shape of the building structure or the type of work to be performed. In such instances, suspended scaffolding may also by used to perform heavier construction tasks.

Unfortunately, while operating heavy stone-cutting equipment, for example, on the work platform of a suspension-type scaffolding, the nearby exposed supporting cables can be severed accidently by only momentary contact with tool. This type of accident is usually fatal to the workmen on the platform and creates a potential hazard to those working or passing below.

It is an object of the invention to protect the supporting cables of a suspension-type scaffolding in the immediate area of the work platform accessible to the workman using the platform.

It is another object of the invention to provide a protective device for the supporting cables of suspension-type scaffolding which is reliable, and easy to install and use, yet relatively inexpensive.

In accordance with the present invention, a protective device is provided for use with a scaffolding platform of the type which is suspended from an upright structure by means of and movable along at least one cable. The protective device is made of a material which protects an exposed zone of the cable adjacent to the platform against damage. The device comprises a weighted sleeve and means for selectively opening and re-closing the weighted sleeve so that it may be placed around the cable at the exposed zone to thereby protect the same. The weighted sleeve is heavy enough to follow the platform under the influence of gravity as the platform is moved along the cable.

BRIEF DESCRIPTION OF THE DRAWINGS

The foregoing brief description and other objects, features and advantages of the present invention will be understood more completely from the detailed description which follows and the drawings, in which.

DETAILED DESCRIPTION OF THE PREFERRED EMBODIMENTS

Figure 1:
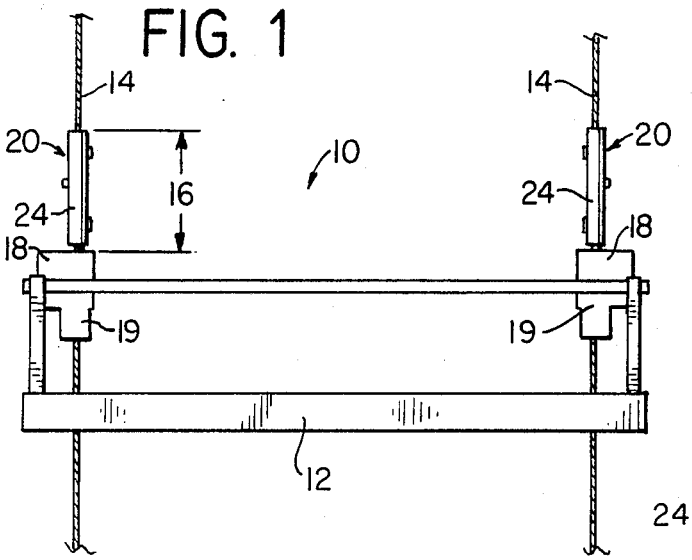
FIG. 1 is a front view of a suspension-type scaffolding which is supported by two cables showing one embodiment of cable in accordance with the invention mounted around each cable.

FIG. 1 shows a typical suspension-type scaffolding assembly 10 having a work platform 12 and cables 14. The cables 14 are suspended from the top of the building on which the scaffolding is mounted, usually by movable booms (not shown). A portion 16 of each cable 14 just above the platform 12 is accessible (exposed) to the workmen and their tools.

Attached to the platform 12 are two motor drive units 18, usually one for each cable used. Each motor drive unit 18 receives one of the cables at either end of the work platform 12 so that a workman may operate the motor drive unit 18 to "drive" the platform in a controlled manner up and down along the cable. The motor drive units 18 also typically include a safety engagement brake 19 that prevents unintended descent caused by slippage between the motor drive mechanism of the motor drive unit 18 and the cable 14. However, the safety engagement brake 19 will not prevent a platform from falling due to a severed cable.

Figure 2:
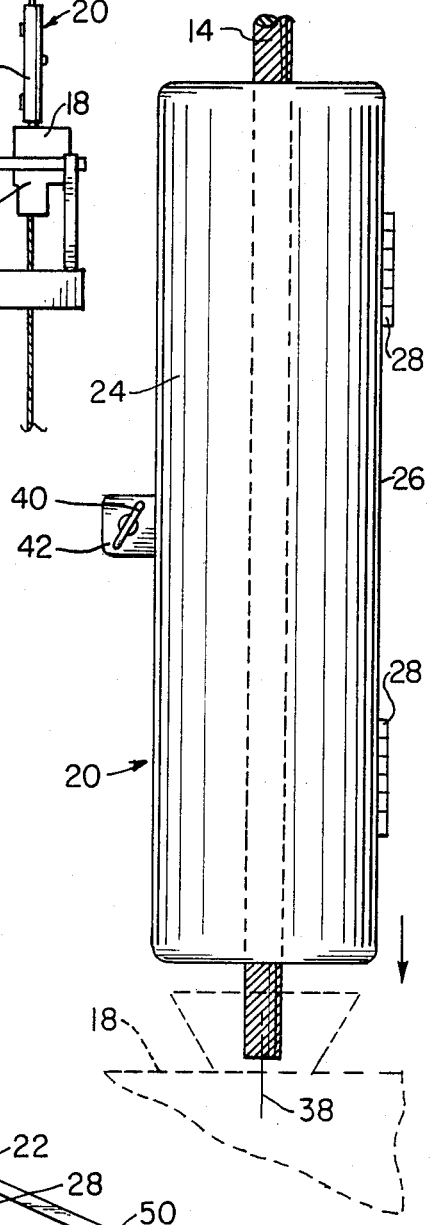
FIG. 2 is an enlarged view of a portion of FIG. 1 showing details of a cable protector in the mounted position.
Figure 3:
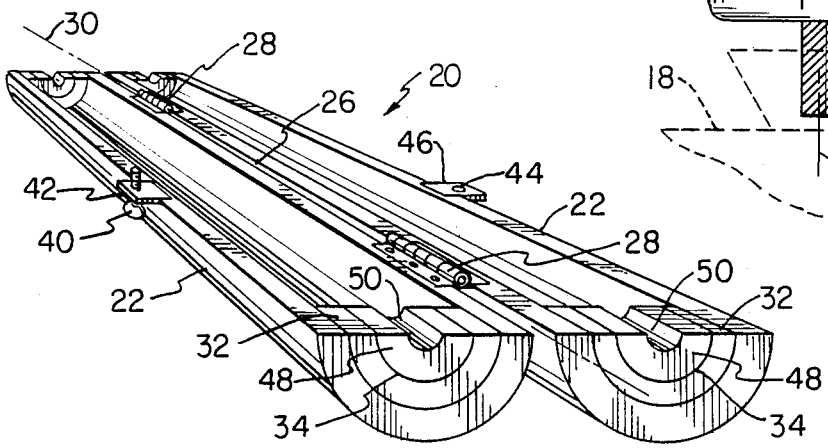
FIG. 3 is a perspective view of the cable protector shown in its open (unmounted) position.
Figure 4:
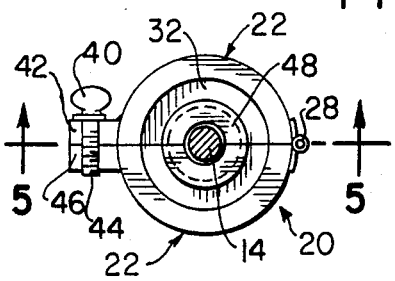
FIG. 4 is a plan view of another embodiment of the invention.
Figure 5:
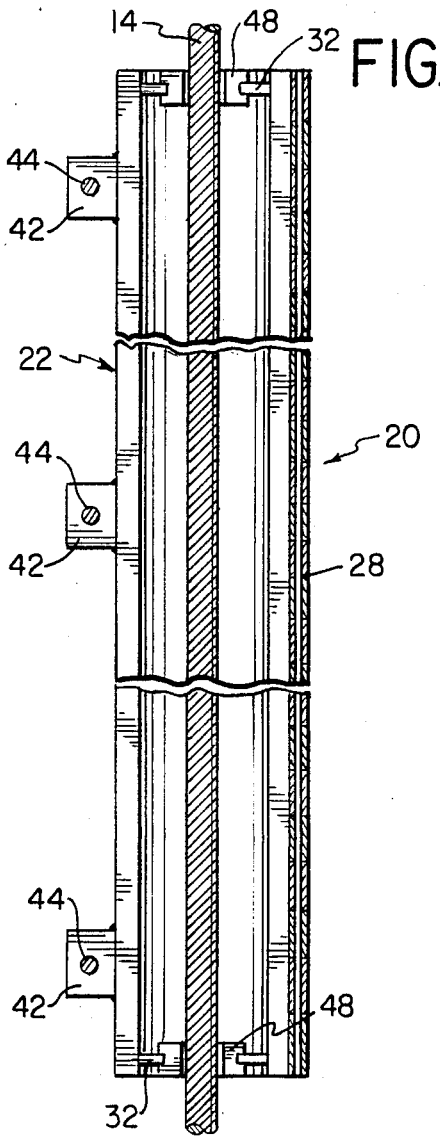
FIG. 5 is a sectional view along lines 5—5 in FIG. 4 and looking in the direction of the arrows.

The protection device 20 according to the invention is shown in a mounted position around each cable 14. As shown in FIG. 3, the device 20 includes two elongated sleeve halves 22 which, when placed together (as in the mounted, closed position, described below) form a hollow cylindrical sleeve 24. The sleeve halves 22 are joined to each other along a common edge 26 with a hinge 28, defining a hinge axis 30 around which the two sleeve halves 22 may rotate between an open position as shown in FIG. 3 and a closed position as shown in FIG. 2. Each sleeve half 22 includes an end cap 32 at each end. Each end cap 32 of each sleeve half 22 includes an arcuate channel 34. In the closed position, the two opposed arcuate channels 34 at each end of the cylindrical sleeve 24 align to form an opening 36 centered along a central axis 38 of sleeve 24. In the closed position, the cable 14 is received in the two openings 36 (one at each end) of the cylindrical sleeve 24. The openings 36 thereby guide the protective device 20 along the cable 14.

A single hand-operated fastener 40 is preferably used to secure the two sleeve halves 22 together in the closed position. The fastener 40 is attached to a fastener plate 42. The fastener plate 42 is attached to one edge of one sleeve half 22 opposite the hinging edge 26. The fastener 40 is received in a diametrically mating bore 44 (such as a threaded bore) located in a receiving plate 46. The receiving plate 46 is attached to the other sleeve half 22 by conventional means such as bolts. The receiving plate 46 is positioned so that when the two sleeve halves 22 are moved to the closed position, the bore 44 aligns with the fastener 40. The fastener plate 42 and one of the sleeve halves 22 may then be secured to the receiving plate 46 and the other sleeve half 22. Of course the number of fasteners 40, fastener plates 42, bore 44 and receiving plates 46 will vary according to the length of the sleeve halves 22.

The length of the cylindrical sleeve 24 is preferably sufficient to cover and protect the exposed portion of one supporting cable. According to this preferred embodiment, the device is made from a strong, non-brittle metal such as steel or aluminum, however, other durable materials such as plastic, and even wood may be used. It is important that the material chosen for the sleeve be resistant to abrasion and other damage caused by contact with a cutting tool. It is appreciated by those skilled in the art that the sleeve material be chosen in accordance with the particular application involved and the type of tool used.

The cylindrical sleeve 24 should be heavy enough (or made heavy enough by adding weights) to follow the platform 12 along the cable 14 at all times, thereby automatically repositioning itself to the exposed working portion 16 of the cable so that the cable is always protected.

The openings 36 at each end of the cylindrical sleeve 24 are preferably somewhat larger than the diameter of the cable 14 to prevent the sleeve 24 from binding the cable when it is in the mounted position. Each opening 36 may (depending on the material chosen for the cylindrical sleeve 24) include a guide insert 48 which is preferably made from a plastic such as nylon. The guide insert 48 is split and attached within each arcuate channel 34 of the sleeve 24 and includes a smaller arcuate channel 50 which, in this case, receives the cable 14. The smaller arcuate channel 50 is preferably only slightly larger than the cable 14. The friction-free nature of the plastic insert prevents any wear or damage to the cable 14 while maintaining a snug fit around the cable 14. The plastic insert 48 may be easily replaced when worn.

In operation, after the work platform is assembled, in position and attached to the supporting cables 14, the protective device is mounted on each cable. To mount it, a workman opens the sleeve 24 and positions it around the cable 14 so that the cable 14 lies along a central axis 38, within two arcuate channels 50 (this version has the plastic inserts). The open sleeve 24 is then closed, thereby capturing the cable 14 in the openings formed by the opposed arcuate channels 50. The two sleeve halves 22 making up the sleeve 24 are then secured together by engaging the fastener 40 in the receiving bore 44, as discussed above. Now in the mounted position, as the platform 12 is driven up or down along the cable 14, the protective sleeves 24 follow and remain within the exposed work portion 16 of the cables 14 under the influence of gravity. The cutting blade of a power tool, for example, will be unable to reach the cable 14 without first penetrating sleeve 24, thereby avoiding accidental damage to the cable. At worst, a tool may damage (nick) the outer surface of the protective sleeve 24. However, the cable 14 will remain protected inside the protective sleeve 24.

The protective sleeve 24 is easily removed from the cable 14 by disengaging fastener 40 from bore 44 and bringing the sleeve halves 22 to the open position. The protective sleeve may then be removed from it respective cable.

Figure 6:
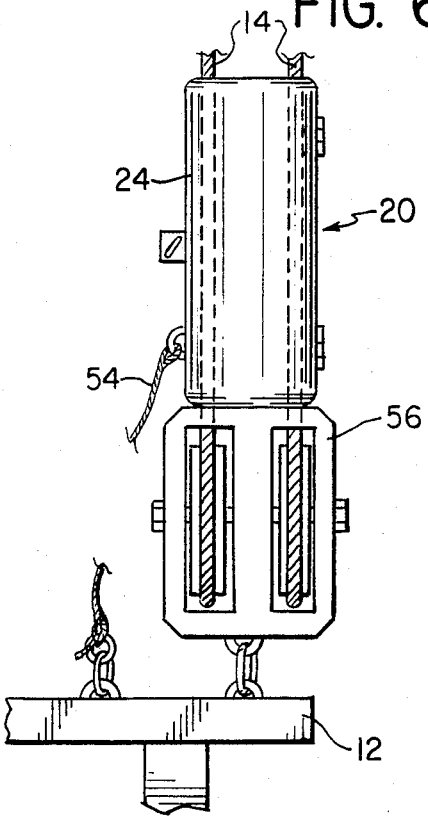
FIG. 6 is an enlarged partial view of a second embodiment of the invention, showing the cable protector mounted about and protecting several cables.

As shown in FIG. 6, a securing tether 54 may be attached to a portion of the sleeve 24 and a portion of the platform 12 as a precaution to prevent a workman from accidentally dropping the protective sleeve assembly 24 while attaching or detaching it from the cable 14, especially when the platform is positioned high above the ground. In this instance, a dropped protective sleeve assembly 24 would be automatically "caught" by the tether 54 and any injury to those workmen below would be prevented.

The present protective sleeve assembly 24 may be any size to fit the particular application. It may be used to protect the exposed zone of any type of supporting cable, cord or rope in the area of any suspended object, such as a work platform. In another related embodiment, the diameter of the sleeve 24 and the openings at either end which receive the cable 14 are large enough to accommodate several individual cables or lengths of rope. This embodiment is particularly useful when the supporting cable or rope is used in combination with a standard pulley block arrangement, as shown in FIG. 6. In this case, the larger protective sleeve 24 would protect a group of cables or ropes going to or coming from a pulley block 56, regardless of their direction of movement.

Figure 7:
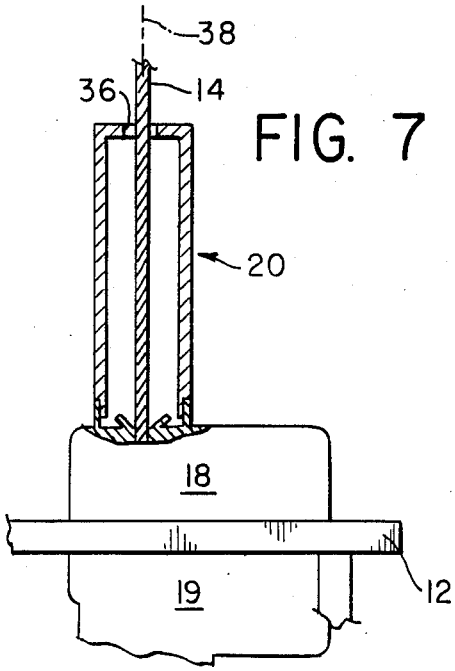
FIG. 7 is an enlarged partially sectional view of a motor drive unit showing details of a cable protector with a securing means in accordance with another embodiment of the invention.

In another embodiment, as shown in FIG. 7, the protective sleeve assembly 24 is attached to the motor drive unit 18. This may be accomplished by forming it integrally with the housing of the motor drive unit 18 or by providing a mating threaded coupling, or the like, to detachably connect the sleeve 24 to the housing of the motor drive unit 18. Another method to attach the sleeve 24 to the motor drive unit 18 is to use the safety tether 54, attaching it between the drive unit housing and the sleeve 24. Attaching the sleeve 24 to the motor drive unit 18 (or the scaffolding platform 12) ensures that the sleeve 24 does not bind along the cable 14 and separate from a descending platform 12, thereby exposing the cable 14.

Although preferred embodiments of the inventions have been disclosed for illustrative purposes, those skilled in the art will appreciate that many additions, modifications and substitutions are possible without departing from the scope or spirit of the invention as defined in the accompanying claims.

What is claimed is:

1. A protective device for use with a scaffolding platform of the type which is suspended from an upright structure by means of and movable along at least one cable, said protective device protecting an exposed zone of the cable adjacent to the platform against damage, said device comprising:

a weighted sleeve; and means for selectively opening and re-closing said weighted sleeve so that it may be placed around said cable at the exposed zone of said cable to protect the same, said weighted sleeve following said platform under the influence of gravity as said platform is moved along said cable.

2. The protective device according to claim 1 wherein said weighted sleeve is an elongated cylinder which is formed by two elongated cylinder halves, said cylinder halves being hingeably attached along a corresponding longitudinal edges, said cylinder halves being thereby relatively pivotable between a closed position wherein said two cylinder halves form said cylinder, and an open position in which said cylinder may be placed about said cable.

3. The protective device according to claim 2 wherein said means for selectively opening and re-closing includes means for securing said two cylinder halves in said closed position.

4. The protective device according to claim 3 wherein said elongated cylinder halves include end cap halves that have passageways with a semicircular cross-section, said end cap halves of corresponding ends of said cylinder halves being aligned when said cylinder halves are in said closed position, the semicircular passageways of the aligned cylinder halves forming cylindrical passageways for the passage of said cable into and out of said cylinder.

5. The protective device according to claim 4 wherein each of said cylindrical passageways include an insert that has a central opening for receiving said cable, said insert being made from a softer material than that of said cylinder to protect said cable from wear.

6. The protective device according to claim 1 wherein said weighted sleeve is sized to accommodate and protect several individual cables.

7. The protective device according to claim 1 further comprising means for connecting said weighted sleeve to said scaffolding platform.

8. The protective device according to claim 7 wherein said connecting means includes the use of a tether cord.

9. The protective device according to claim 7 wherein said scaffolding platform includes a motor drive unit for moving said cable with respect to said scaffolding platform and wherein said connecting means includes a threaded coupling between a lower portion of said sleeve and said motor drive unit of said scaffolding platform.

10. The protective device according to claim 1 wherein said weighted sleeve is made from metal.

11. A method of protecting an exposed zone of cable used for supporting a suspension type scaffolding platform, said exposed zone being located near said scaffolding platform, said scaffolding being movable along said cable, said method comprising the step of:

positioning a weighted protective sleeve around said cable in said exposed zone so that said sleeve, under the influence of gravity, freely follows said scaffolding platform, thereby always protecting said exposed zone of cable.

* * * * *